US009421411B2

(12) United States Patent
Stallman

(10) Patent No.: US 9,421,411 B2
(45) Date of Patent: Aug. 23, 2016

(54) EXERCISE DEVICE

(71) Applicant: James J. Stallman, N. Olmsted, OH (US)

(72) Inventor: James J. Stallman, N. Olmsted, OH (US)

( * ) Notice: Subject to any disclaimer, the term of this patent is extended or adjusted under 35 U.S.C. 154(b) by 191 days.

(21) Appl. No.: 14/203,447

(22) Filed: Mar. 10, 2014

(65) Prior Publication Data

US 2014/0315700 A1 Oct. 23, 2014

Related U.S. Application Data

(60) Provisional application No. 61/774,586, filed on Mar. 8, 2013.

(51) Int. Cl.

| | |
|---|---|
| ***A63B 21/00*** | (2006.01) |
| ***A63B 23/12*** | (2006.01) |
| *A63B 21/068* | (2006.01) |
| *A63B 71/02* | (2006.01) |

(52) U.S. Cl.

CPC ..... *A63B 21/00047* (2013.01); *A63B 23/1236* (2013.01); *A63B 21/068* (2013.01); *A63B 2071/025* (2013.01); *A63B 2210/50* (2013.01)

(58) Field of Classification Search

CPC ..... A63B 21/00

USPC ..... 482/141, 142

See application file for complete search history.

(56) References Cited

U.S. PATENT DOCUMENTS

| | | | |
|---|---|---|---|
| 5,257,701 | A | 11/1993 | Edelson |
| 5,697,875 | A | 12/1997 | Stan |
| 7,367,928 | B2 | 5/2008 | Storch |
| 7,658,702 | B1 | 2/2010 | Harms |
| 8,216,114 | B1 | 7/2012 | Wynn |
| 8,267,840 | B2 | 9/2012 | Barnes |
| 8,317,664 | B2 | 11/2012 | Gorsuch |
| 2009/0124471 | A1 | 5/2009 | Storch |

*Primary Examiner* — Jerome w Donnelly
(74) *Attorney, Agent, or Firm* — Dwight A. Stauffer

(57) ABSTRACT

An exercise device is disclosed for use in performing pushups, the exercise device including an elongate hand support structure adjacent an elongate foot support structure. A top end of the hand support structure is attached to a corresponding top end of the foot support structure, and at least a bottom end of the hand support structure is spaced apart from a corresponding bottom end of the foot support structure. The hand support structure includes a pair of laterally spaced-apart, generally parallel elongate hand support rails having longitudinally spaced-apart handle mounts. The foot support structure includes a pair of laterally spaced-apart, generally parallel elongate foot support rails having longitudinally spaced-apart platform mounts. The exercise device further includes a handle configured for selectable attachment to the handle mounts and a foot platform configured for selectable attachment to the platform mounts.

18 Claims, 10 Drawing Sheets

EXERCISE DEVICE

CROSS-REFERENCE TO RELATED APPLICATIONS

This application claims the benefit of U.S. Provisional Patent Application No. 61/774,586, filed Mar. 8, 2013 by James J. Stallman, said application hereby incorporated in its entirety by reference herein.

TECHNICAL FIELD OF THE INVENTION

The present invention relates to exercise devices, and more particularly to an exercise device for performing pushups at selectable levels of difficulty.

BACKGROUND OF THE INVENTION

Various types of devices for assisting in exercise routines have been used in the industry. Existing devices can range from simple benches or frames to large complex exercise equipment. These existing devices can be large, heavy, and not easily transported or collapsed for compact storage. Known simple benches or frames may include an adjustable height platform or cross bar for use in performing pushups. However, these known devices are not easily foldable into a single, tightly compact form, do not include options for both foot and hand ergonomic supports at adjustable heights on a single device, and do not provide ergonomic head clearance/hand support options for use. What is needed is an exercise device that is simple, lightweight, having height adjustable ergonomic support options, and folding quickly and easily compact for storage and transport.

BRIEF SUMMARY OF THE INVENTION

According to an embodiment of the present invention an exercise device is disclosed for use in performing pushups, the exercise device includes an elongated hand support structure adjacent an elongated foot support structure. A top end of the hand support structure is attached to a corresponding top end of the foot support structure, and at least a bottom end of the hand support structure is spaced apart from a corresponding bottom end of the foot support structure. The hand support structure includes a pair of laterally spaced-apart, generally parallel elongate hand support rails having longitudinally spaced-apart handle mounts. The foot support structure includes a pair of laterally spaced-apart, generally parallel elongate foot support rails having longitudinally spaced-apart platform mounts. The exercise device further includes a handle configured for selectable attachment to the handle mounts and a foot platform configured for selectable attachment to the platform mounts.

According to another embodiment of the present invention an exercise device includes an elongated hand support structure adjacent an elongated foot support structure. A top end of the hand support structure is pivotally attached to a corresponding top end of the foot support structure. At least a bottom end of the hand support structure is spaced apart from a corresponding bottom end of the foot support structure to form a generally A-frame shape when the device is in an open position. The hand support structure includes a pair of laterally spaced-apart, generally parallel elongate hand support having longitudinally spaced-apart pairs of handle mounts. The foot support structure includes a pair of laterally spaced-apart, generally parallel elongate foot support rails having longitudinally spaced-apart platform mounts. The exercise device further includes a pair of handles configured for selectable attachment to the corresponding pair of the handle mounts, a foot platform configured for selectable attachment to the platform mounts, and a cross link is configured for attachment between the hand support structure and the spaced-apart foot support structure when the device is in an open position. The cross link is configured for pivotal movement from a collapsed storage position when the device is in a closed position into a secure latching position when the device is in the open position.

According to a further embodiment of the present invention a method of assembling an exercise device for use in performing pushups includes attaching the top end of an elongated hand support structure to a corresponding top end of an elongated foot support structure. The method further includes constructing the hand support structure to comprise a pair of spaced-apart, generally parallel elongate hand support rails, each of the hand support rails including longitudinally spaced-apart handle mounts. The method also includes constructing the foot support structure to comprise a pair of spaced-apart, generally parallel elongate foot support rails, each of the foot support rails including longitudinally spaced-apart platform mounts. The method further includes spacing apart a bottom end of the hand support structure from a corresponding bottom end of the foot support structure to form a generally A-frame shape, attaching at least one handle to the handle mounts, and attaching at least one foot platform to the platform mounts.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1:
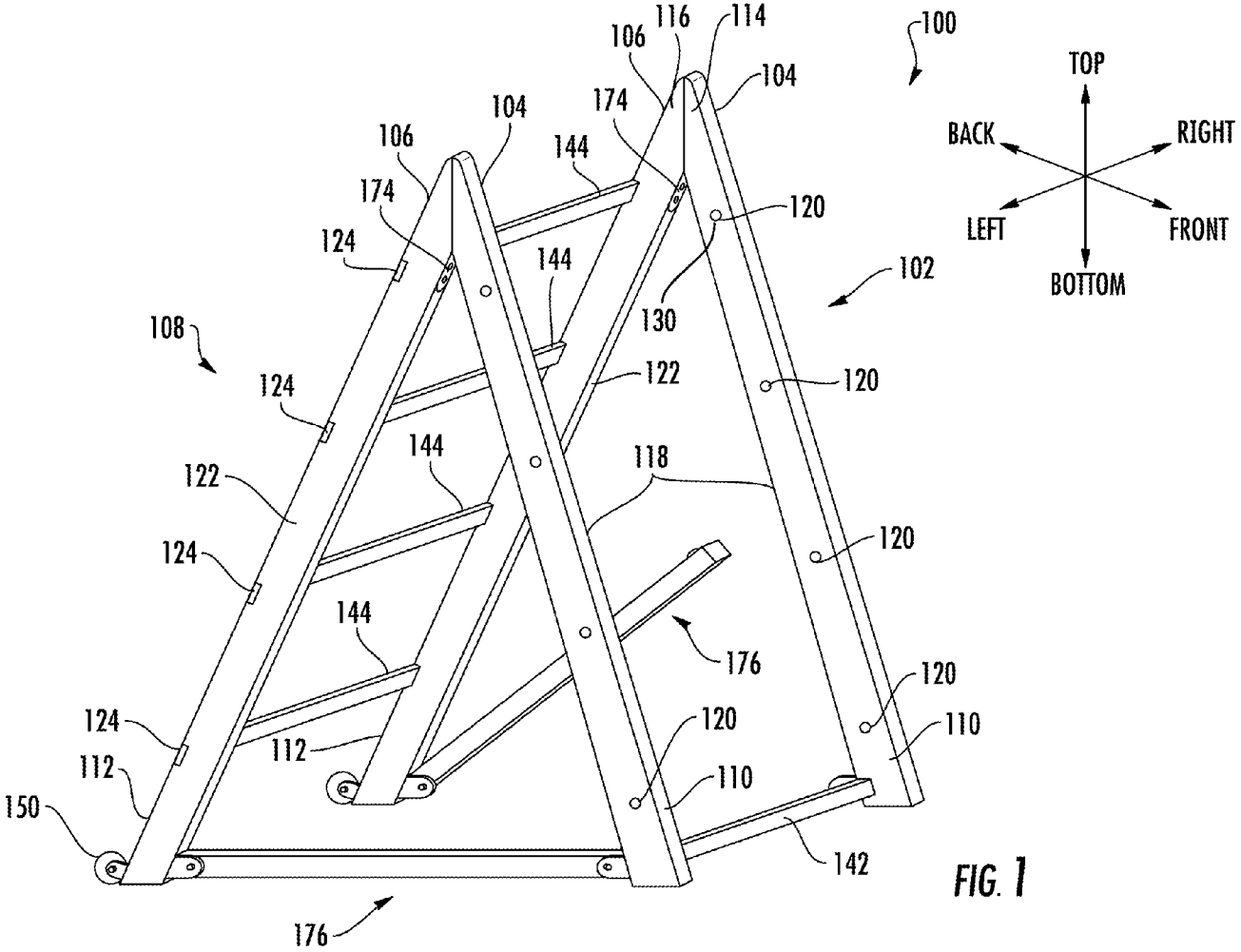

The structure, operation, and advantages of the present preferred embodiment of the invention will become further apparent upon consideration of the following description taken in conjunction with the accompanying drawings, wherein:

FIG. 1 is a perspective view of an exercise device, according to the invention.

Figure 2:
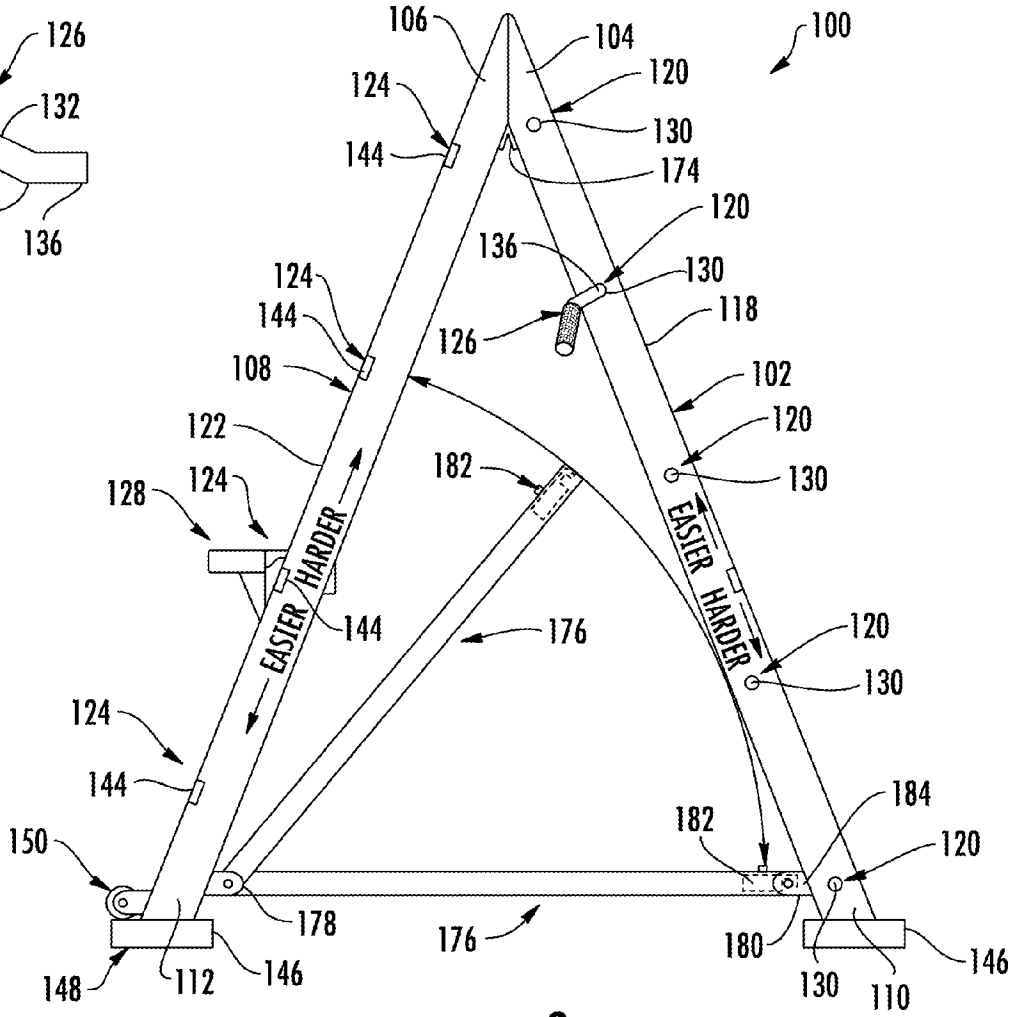

FIG. 2 is a side elevation view of the exercise device of FIG. 1, particularly showing a cross link that is movable for collapsing, according to the invention.

Figure 3:
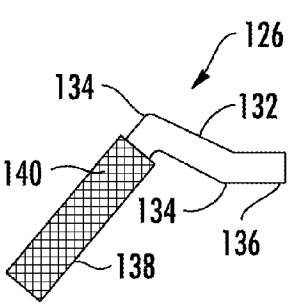

FIG. 3 is an enlarged plan view of a handle of the exercise device of FIG. 1, according to the invention.

Figure 4:
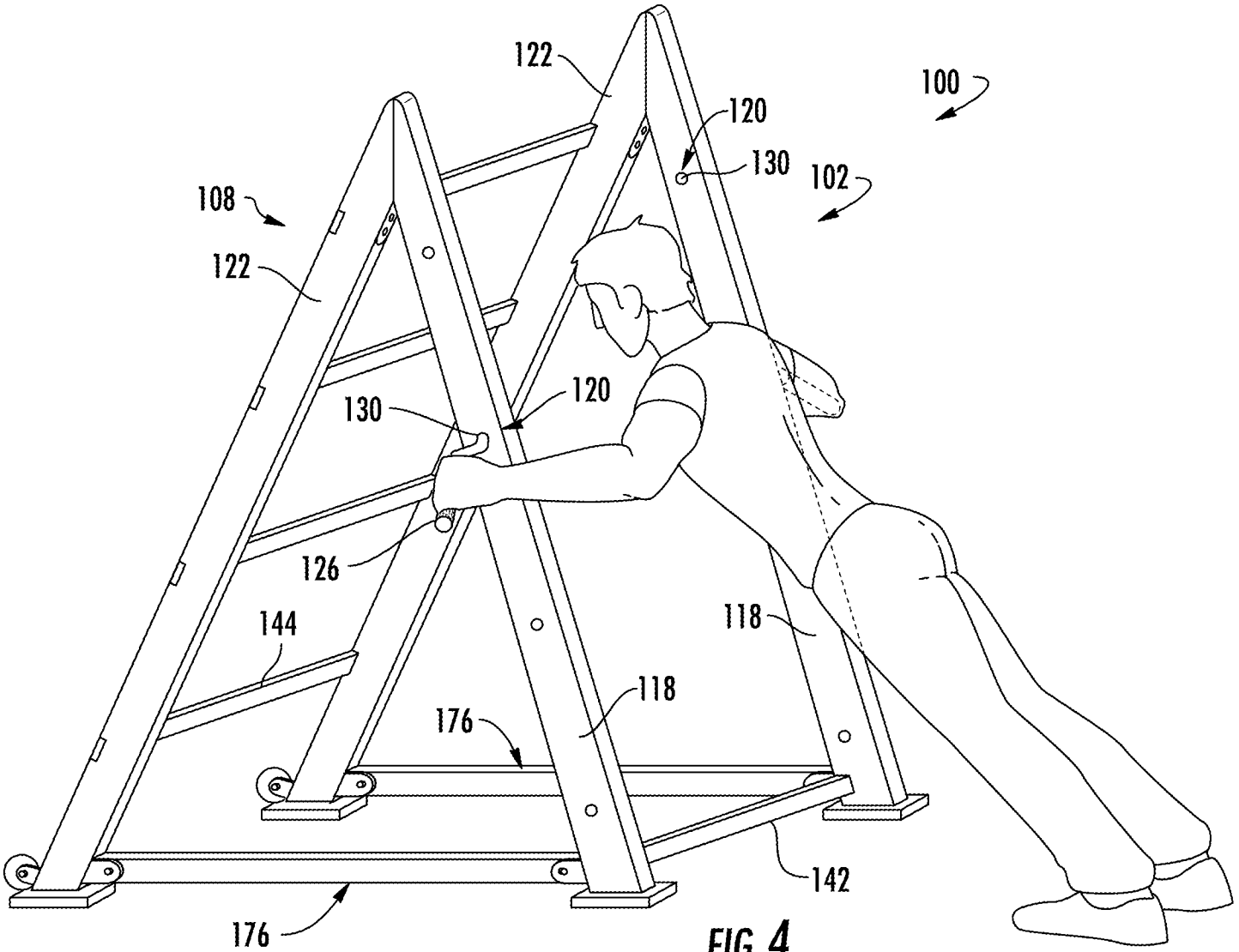

FIG. 4 is a perspective view of the exercise device of FIG. 1, showing a user standing near the front of the device with hands positioned on the handles and performing a push up, according to the invention.

Figure 5:
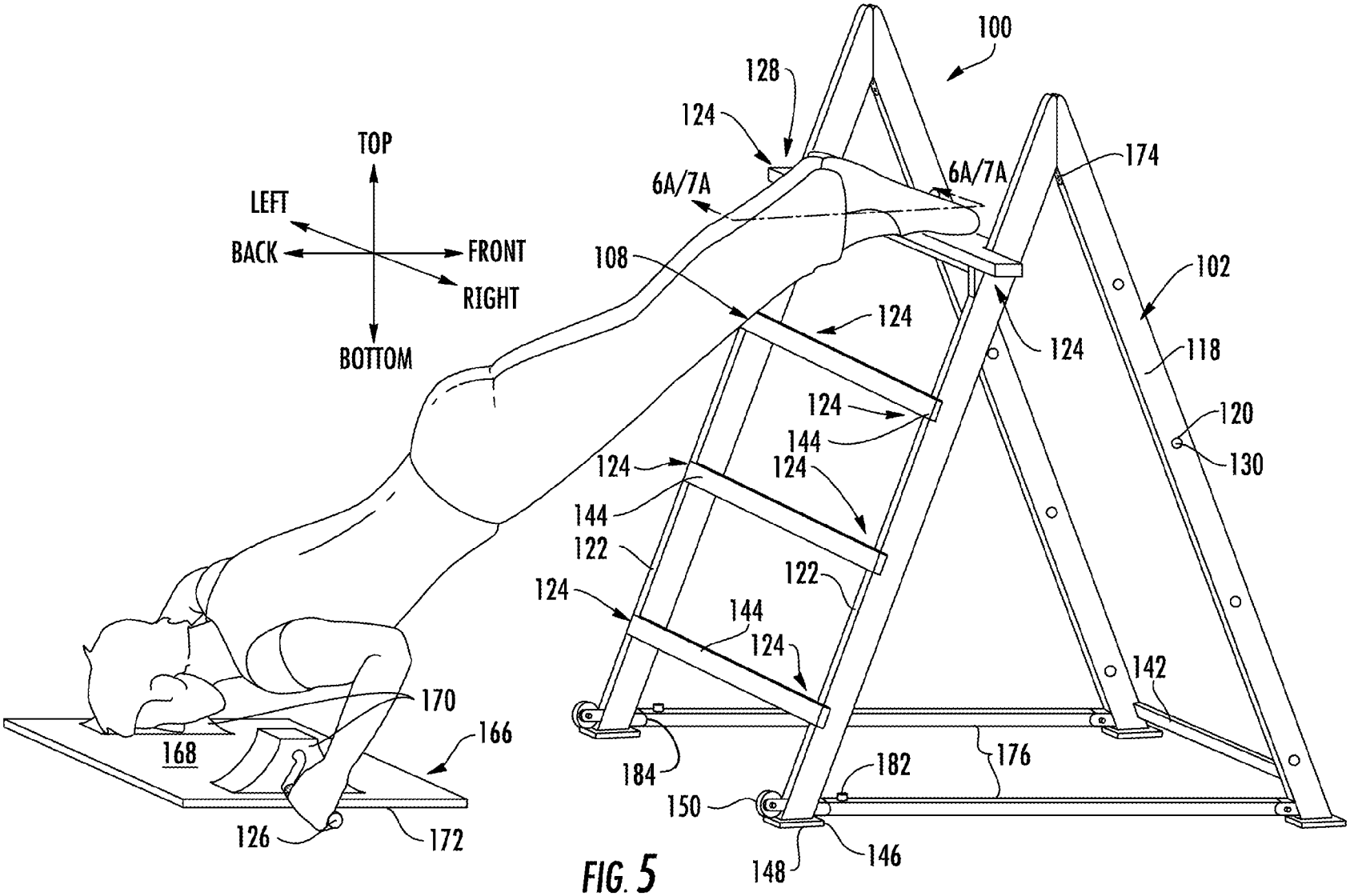

FIG. 5 is a perspective view of the exercise device of FIG. 1 showing a user working at the back of the device with hands positioned on the handles of a floor platform, feet elevated onto a foot platform, and performing a push up, according to the invention.

Figure 6A:
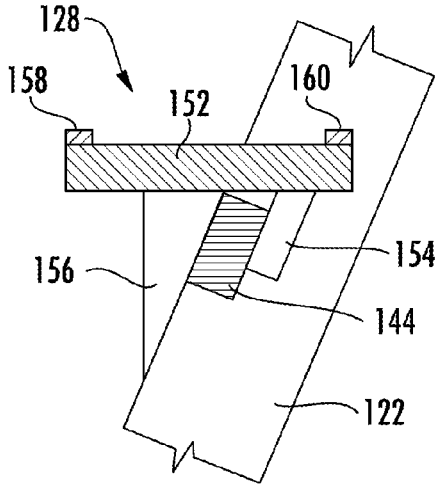

FIG. 6A is a side cross section view of a first embodiment of foot platform mounted on the exercise device, the view taken along the line 6A/7A-6A/7A in FIG. 5, according to the invention.

Figure 6B:
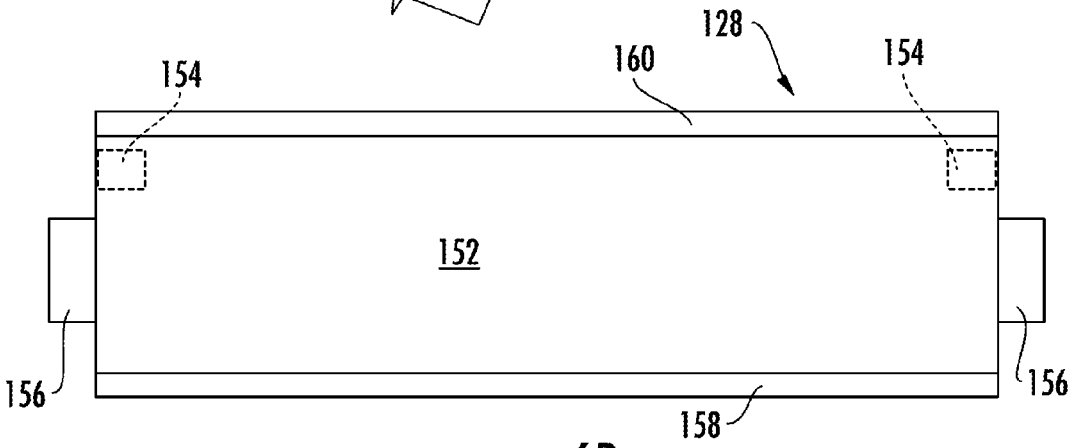

FIG. 6B is a plan view of the foot platform of FIG. 6A, according to the invention.

Figure 7A:
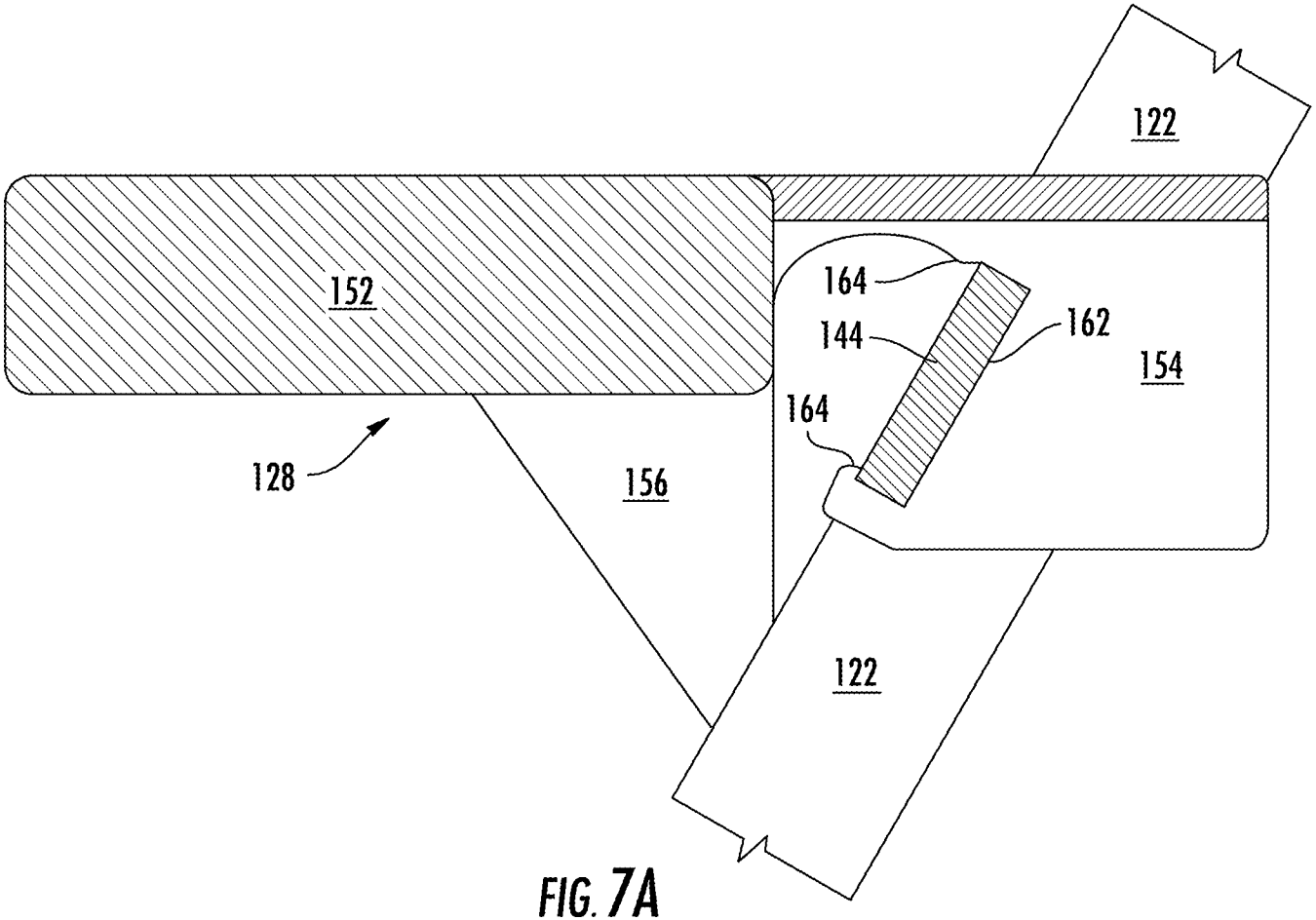

FIG. 7A is a side cross section view of a second embodiment of foot platform mounted on the exercise device, the view taken along the line 6A/7A-6A/7A in FIG. 5, according to the invention.

Figure 7B:
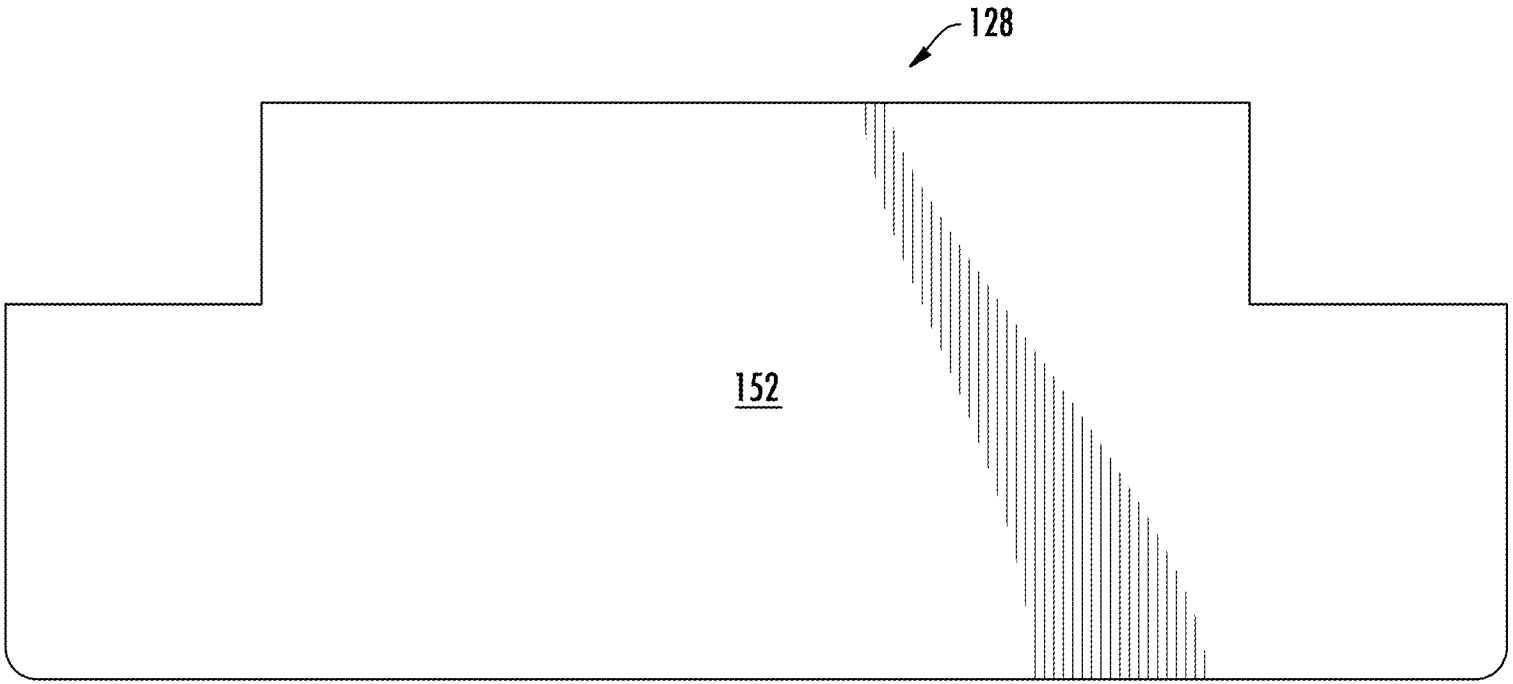

FIG. 7B is a plan view of the foot platform of FIG. 7A, according to the invention.

Figure 8A:
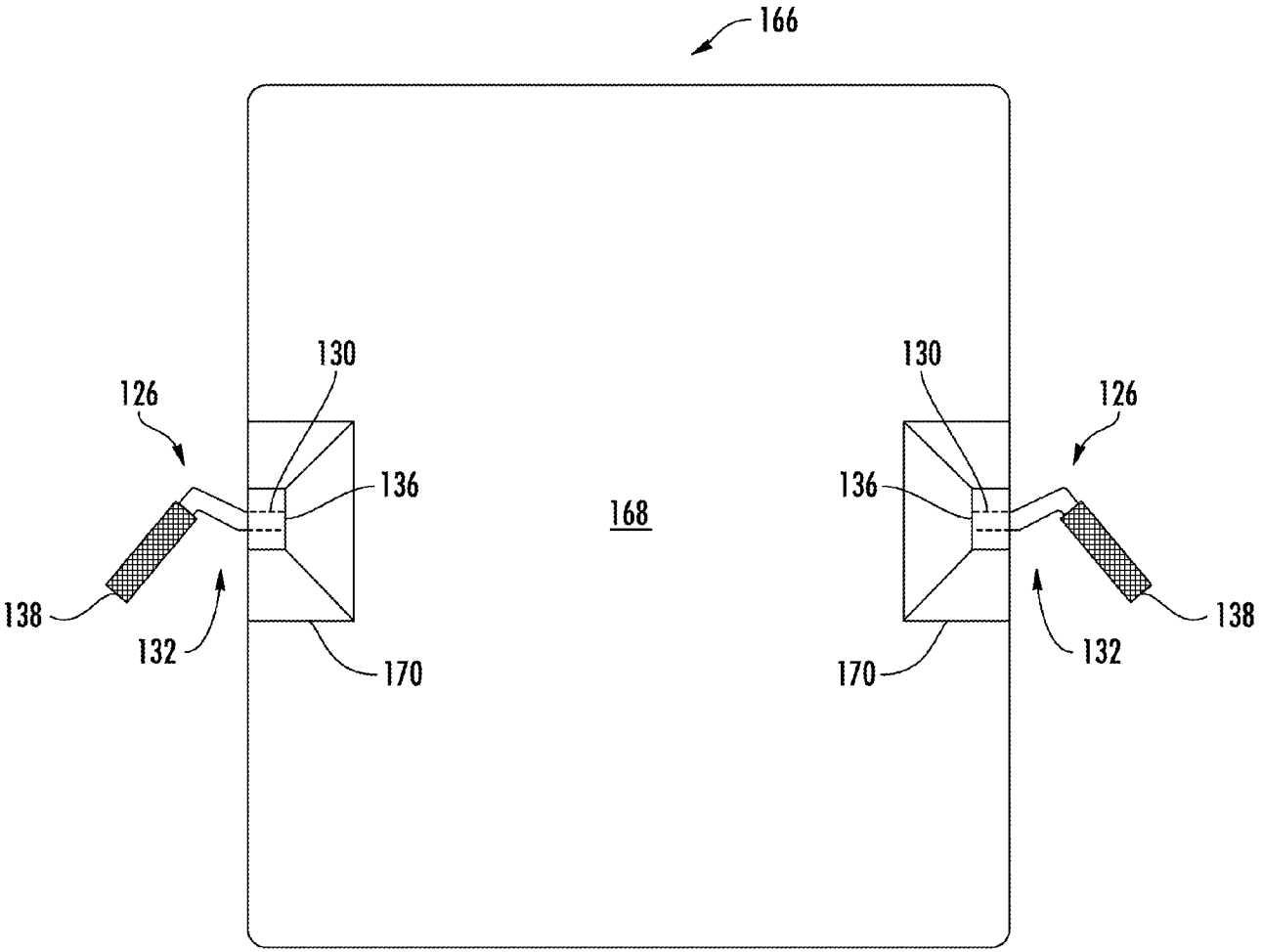

FIG. 8A is a plan view of the floor platform from FIG. 5, according to the invention.

Figure 8B:
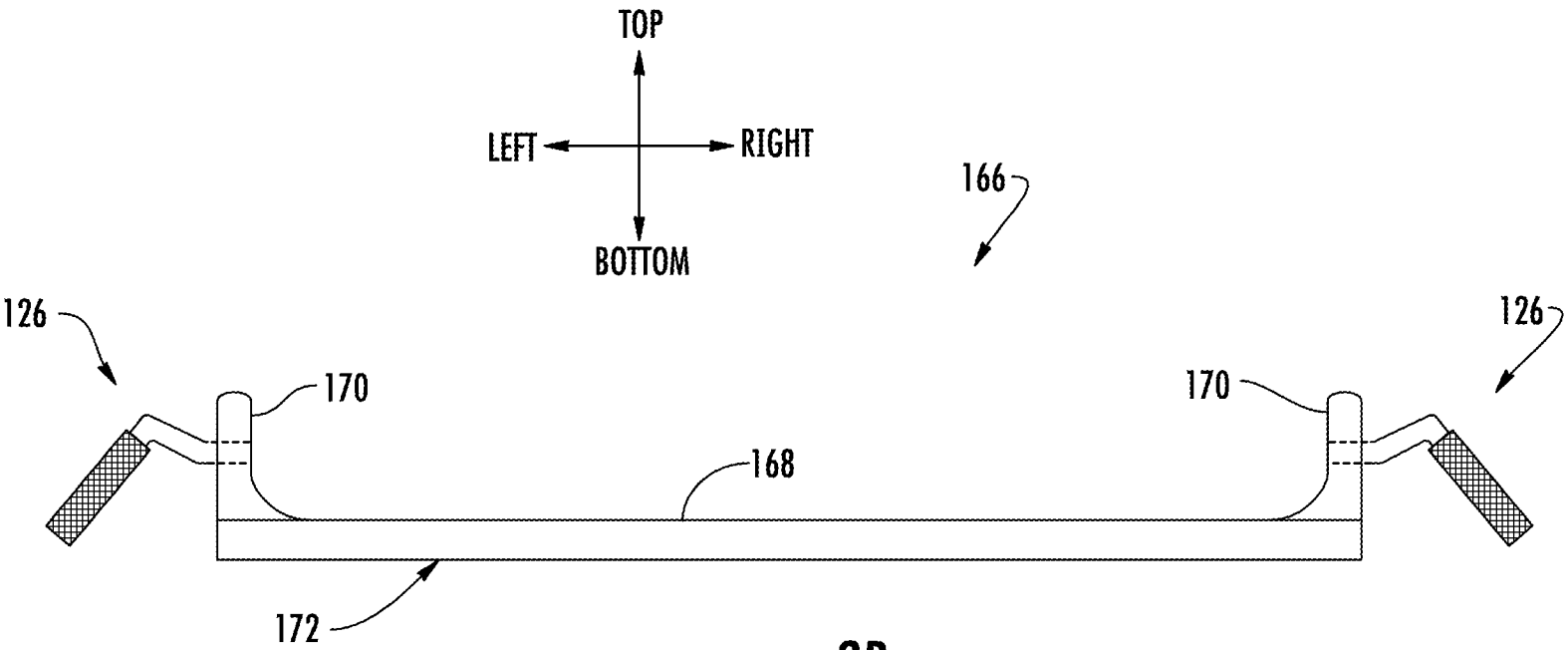

FIG. 8B is an end elevation view of the floor platform of FIG. 8B, according to the invention.

Figure 9:
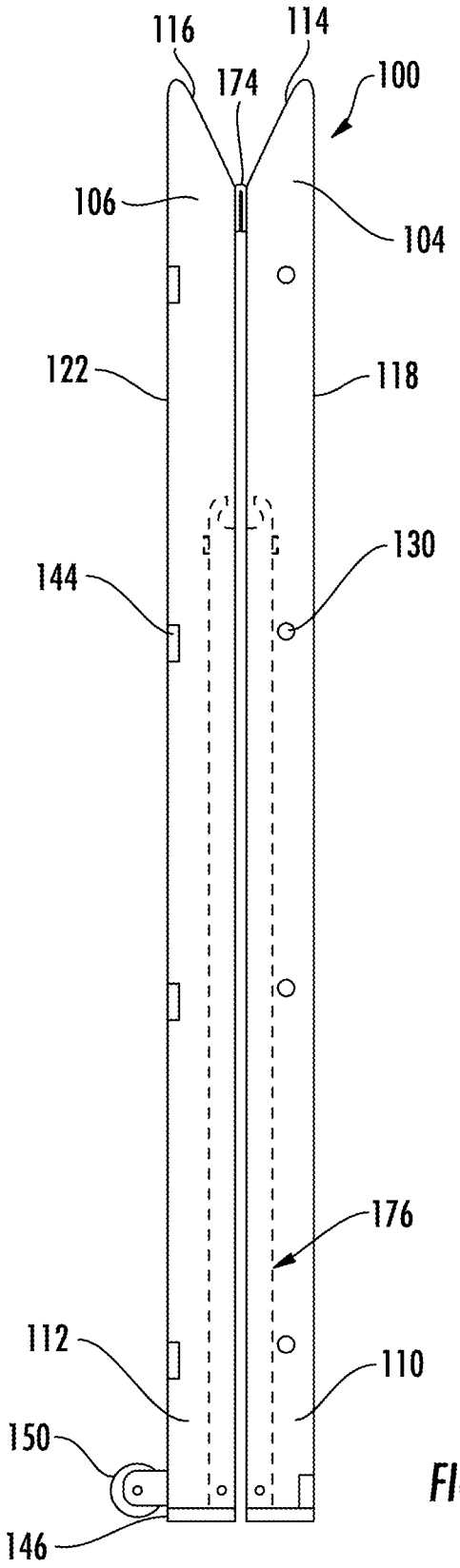

FIG. 9 is a side elevation view of the exercise device of FIG. 1, showing it in a collapsed position, according to the invention.

DETAILED DESCRIPTION OF THE INVENTION

Drawing reference numbers for terms and elements in the disclosure are listed as follows:

| Ref. No. | Brief Definition |
|---|---|
| 100 | exercise device |
| 102 | hand support structure |
| 104 | top end (hand support structure) |
| 106 | top end (foot support structure) |
| 108 | foot support structure |
| 110 | bottom end (hand support structure) |
| 112 | bottom end (foot support structure) |
| 114 | chamfered edge (hand support structure) |
| 116 | chamfered edge (foot support structure) |
| 118 | hand support rails |
| 120 | handle mounts |
| 122 | foot support rails |
| 124 | platform mounts |
| 126 | handle |
| 128 | foot platform |
| 130 | aperture (at handle mounts) |
| | 132-140 Refer To Elements Of a Handle 126 |
| 132 | contoured portion |
| 134 | angled bends |
| 136 | proximal end |
| 138 | distal end |
| 140 | grip portion |
| 142 | cross brace (hand support structure) |
| 144 | cross brace (foot support structure) |
| 146 | floor pads |

-continued

| Ref. No. | Brief Definition |
|---|---|
| 148 | bottom surface (of floor pads) |
| 150 | wheel |
| | 152-164 Refer To Elements Of a Foot Platform 128 |
| 152 | base (of foot platform) |
| 154 | hook |
| 156 | strut |
| 158 | front raised edge |
| 160 | back raised edge |
| 162 | recess |
| 164 | protrusion |
| | 166-172 Refer To Elements Of a Floor Platform 166 |
| 166 | floor platform |
| 168 | base (of floor platform) |
| 170 | handle mounts (floor platform) |
| 172 | bottom surface (of floor platform) |
| 174 | pivot (pivoting connection between support structures) |
| | 176-184 Refer To Elements Of a Cross Link 176 |
| 176 | cross link between support structures |
| 178 | first end |
| 180 | second end |
| 182 | latch |
| 184 | receptor |

FIGS. 1-5 illustrate an exemplary, non-limiting embodiment of an exercise device 100 for use in performing pushups. The pushup exercise device is designed to assist any user from novice to expert to perform better pushups. The exercise device is designed so the user may perform pushups either facing toward the front of the device using their hands pushing against it, or facing away from the back of the device using their feet pushing against it. The position level where the user's hands or feet are braced against the device can be moved to higher or lower positions on the device to provide different levels of difficulty. Positioning hands at the top level provides the easiest level of difficulty, and positioning the hands at the lowest level provides the level of most difficulty. An optional adjacent floor platform may be used with the device to brace the user's hands against. The user may position their hands on the floor platform, and position their feet on the back of the exercise device at different levels. Positioning feet at the lowest setting provides the easiest level of difficulty and positioning the feet at the top setting provides the level of most difficulty. The exercise device is designed to fold together for convenient storage when not in use.

Referring to FIGS. 1-5, a pushup exercise device 100 is shown. The exercise device 100 includes an elongate hand support structure 102 adjacent to and attached at a top end 104 to a corresponding top end 106 of an elongate foot support structure 108. In a preferred embodiment the hand support structure 102 and the foot support structure 108 form a generally A-frame shape wherein a bottom end 110 of the hand support structure 102 is spaced apart from a corresponding bottom end 112 of the foot support structure 108 when the device is in an open position. The top end 104 of the hand support structure 102 and the top end 106 of foot support structure 108 may each include an opposing chamfered edge 114, 116, respectively, configured to allow the top ends 104, 106 to be closely abutting when the exercise device 100 is in the open position. The hand support structure 102 includes a pair of laterally spaced-apart, generally parallel elongate hand support rails 118 having longitudinally spaced-apart handle mounts 120. The foot support structure 108 includes a pair of laterally spaced-apart, generally parallel elongate foot support rails 122 having longitudinally spaced-apart platform mounts 124.

The exercise device 100 further includes a handle 126 configured for removable attachment to selected ones of the handle mounts 120, and a foot platform 128 is configured for removable attachment to selected ones of the platform mounts 124 (see FIG. 2). The handle mounts 120 may include pairs of laterally opposed apertures 130 in the hand support rails 118 configured for selectably receiving the handle 126. Alternatively, handle mounts 120 may be any suitable support member configured to receive handle 126, such as a bracket, saddle, flanged post or clamp mounted to or integral with hand support rails 118. In order for the user to quickly and easily position the handle 126 at various elevations on the hand support rails, at least one of the apertures 130, handle mounts 120 and the handle 126 may include a quick-release feature (not shown). The quick-release feature may be any suitable feature such as a spring-loaded detent or clamp, for example.

As best seen in FIG. 3, the handle 126 includes a contoured portion 132 having one or more angled bends 134 configured to provide an ergonomic position for a user's hand when performing pushups. Handle 126 includes a proximal end 136 configured for selectable attachment to the handle mounts 120 and a distal end 138 configured for engaging the user's hands during use of the exercise device 100. Distal end 138 may include a cushioned hand grip portion 140 configured to provide a contoured, slip-resistant and/or cushioning resilient surface or feature for engaging the user's hand. Referring to FIG. 4, handle 126 is configured as one left handle paired with a separate right handle for selectable attachment to a corresponding pair of the handle mounts 120. The handle 126 is configured for attachment to the hand support rails 118 such that the left handle extends outwardly away from the handle mount 120 on a left side hand support rail 118 and the right handle extends outwardly away from the handle mount 120 on a right side hand support rail 118. Alternatively, handle 126 may be configured as a handle bar (not shown) that extends between, and optionally also outward beyond, opposing hand support rails 118, or may include rigid, flexible or semi-rigid loops of material. To work with alternative embodiments, the aperture 130 may be an open notch, for example.

In a further alternative, a plurality of the handles 126 may be pivotally mounted to the pairs of handle mounts 120, and be configured for selectable movement from a collapsed position for storage/non-use into a secured, open position. Further, although the handle 126 form is shown as generally tubular, it may have any suitable cross section, such as oval, rectangular, or triangular, for example, and the aperture 130 may have a suitably corresponding cross section. In particular, at least the proximal end 136 of the handle 126 and the aperture 130 of the handle mount 120 may have corresponding non-circular cross sections such that the ergonomic handle 126 will position itself at a predetermined optimum rotational orientation when it is mounted in a handle mount 120.

As best seen in FIGS. 1 and 4, a cross brace 142 is preferably provided for structural stability, laterally extending between corresponding attachments on the pair of hand support rails 118. Cross brace 142 is positioned generally perpendicular to and extending between the hand support rails 118. If present, the cross brace 142 is preferably located at the bottom end 110 of the hand support structure 102, in order to avoid obstructing movement of a user's head as he/she performs pushups as shown in FIG. 4, for example.

Referring also to FIG. 5, at least one of the platform mounts 124 of the foot support rails 122 includes a stabilizing cross brace 144 laterally extending between corresponding attachments on the pair of foot support rails 122. The cross brace 144 is positioned generally perpendicular to, and attached to the pair of foot support rails 122. Alternatively, platform mounts 124 may be any suitable attachment member configured to receive the foot platform 128, for example a bracket, saddle, groove, notch, flanged post, clamp, and the like; being mounted to or integral with the foot support rails 122, and longitudinally spaced apart as described hereinabove. Cross braces 142, 144, handle mounts 120, and platforms mounts 124 may be connected to exercise device 100 by any suitable feature such as fasteners, adhesive, or by friction fit, for example, or made integral with the hand support rails 118 and the foot support rails 122.

As seen in FIGS. 2, 4, 5, the exercise device 100 may include one or more slip-resistant floor pads 146 on a bottom surface thereof. The bottom end 110 of the hand support structure 102 and/or the bottom end 112 of the foot support structure 108 are attached to one or more floor pads 146. Floor pads 146 may include a slip-resistant feature as a bottom surface 148. The bottom surface 148 includes any suitable slip-resistant feature such as textured, contoured, gripping, resilient or cushioning material that substantially prevents the exercise device 100 from moving relative to an underlying surface when in use. Floor pads 146 may be pivotally connected to the exercise device 100 to allow for self or manual leveling or adjustment of the device against an underlying surface. In an embodiment, exercise device 100 may include one or more wheels 150 configured for rollingly moving the exercise device when it is positioned to engage the one or more wheels on a supporting surface. Wheels 150 may be attached at the bottom ends 110, 112 to provide ease of transport of the exercise device 100 when not in use, for example a collapsed exercise device 100 illustrated in FIG. 9 may be tilted enough to position the wheels on the floor which lifts the floor pads 146 to enable free rolling movement.

Referring to FIGS. 5, 6A and 6B, the foot platform 128 includes a generally horizontal base 152, a hook 154, and a strut 156. The foot platform 128 is configured such that, when the foot platform is attached to the platform mount 124, base 152 extends laterally (widthwise) between the pair of foot support rails 122 and has a width and a depth dimension configured for suitable support of a user's feet while performing pushups. In this manner, the user can perform pushups with their feet elevated and their hands below, the hands being unsupported by the foot support structure 108. In this embodiment the hook 154 is configured to hook behind the cross brace 144 of the platform mount 124, may be one or more spaced-apart hooks 154, and may be configured to abut an adjacent foot support rail 122. The strut 156 extends downward from the base 152 to supportingly engage at least one of the foot support rails 122 when the foot platform 128 is attached to a selected one of the platform mounts 124.

Preferably the foot platform 128 further includes features for safely securing a user's toes/feet on the foot platform. For example, at least one of a slip-resistant surface (not shown, but with similar features to bottom surface 148), a front raised edge 158 and a back raised edge 160 may be provided. Of course many ways to secure the feet will occur to one of ordinary skill in the related art, and all are intended to be within the scope of the present invention. In addition to the above-described, a non-limiting list of further examples may include one or more depressions in the platform base 152, and this can be extended to a form of stirrups hanging from a suitable attachment at the selectable platform mounts 124.

In an embodiment, a plurality of the foot platforms 128 are mounted to a corresponding plurality of the platform mounts 124, thereby extending between pairs of laterally opposed platform mounts 124 and attaching to the pair of foot support rails 122 at longitudinally spaced apart locations 124. In this case the platform and mounts can be simplified to replace the cross braces 144 with substantially permanently attached foot platform bases 152.

In an embodiment, a plurality of the foot platforms 128 may include a base 152 pivotally mounted to the pair of platform mounts 124, and be configured for selectable movement from a collapsed position for storage/non-use into a secured, open position for use.

Referring to FIGS. 7A, 7B, another embodiment of the foot platform 128 is shown in which the hook 154 is configured to provide a more secure attachment to the platform mount 124 to substantially prevent movement or accidental removal of the foot platform during use. Hook 154 includes a recess 162 and protrusions 164 configured for selectable engagement with or a cross brace 144 form of the platform mount 124. Protrusions 164 are positioned proximate to recess 162 and may be any suitable geometric shape such as ridges or hooks, for example. During engagement, hook 154 may be temporarily deformed to allow a friction fit with platform mount 124 cross brace 144. Alternatively, at least one of the hook 154 and platform mount 124 or cross brace 144 may include a quick-release feature (not shown). The quick-release feature may be any suitable feature such as a spring-loaded detent or clamp, for example.

Referring to FIGS. 5, 8A, 8B, the exercise device 100 preferably includes a floor platform 166 configured for selectable attachment of the handle 126. The floor platform 166 includes a base 168 and a pair of spaced-apart handle mounts 170 extending upwardly therefrom. The handle 126 is preferably configured as a left handle paired with a separate right handle for selectable attachment to a corresponding pair of left and right handle mounts 170 such that the distal end 138 of the handles extend outwardly away from the floor platform 166 and are elevated above any surface therebelow. The floor platform 166 may include a slip-resistant bottom surface 172 having similar features to bottom surface 148, to prevent slipping and/or sliding on an underlying surface, particularly while the floor platform 166 is being used for pushup exercise.

As shown in FIG. 5, a user may position their hands on the handles 126 and their feet on the foot platform 128 to form an acute angle of their body relative to the underlying surface, placing their head below their feet such that they are performing inverted pushups. This shifts the body's center of gravity above the shoulders at a height that increases along with the selected foot support height, bringing more body weight to bear on the user's arms, and thus providing a greater level of difficulty in performing pushups.

The floor platform 166 is not required for performing pushups, but it makes inverted pushups somewhat more comfortable which encourages use of the exercise device 100. In particular, referring to FIG. 3, the ergonomically shaped handle 126 hand support structure 102 with the contoured portion 132 having angled bends 134 and with an optionally cushioned grip portion 140, is used with the floor platform 166, which has handle mounting apertures 130 that match those on the hand support structure 102 so that the handle's proximal end 136 can be suitably inserted and secured in the apertures 130 wherever selected.

Referring to FIGS. 1, 2, 4, 5, 9, exercise device 100 includes a collapsible structure wherein a pivot 174 is configured for pivotal attachment of the top end 104 of the hand support structure 102 to the corresponding top end 106 of the foot support structure 108. Exercise device 100 may also include at least one cross link 176 configured for attachment between the hand support structure 102 and the foot support structure 108. The cross link 176 is configured for selectably latching at a full length to space apart the bottom ends 110, 112 respectively, of the hand support structure 102 and the foot support structure 108 when the exercise device 100 is in an open position for use, or collapsing to position the hand support structure 102 substantially adjacent and parallel to the foot support structure 108 when the exercise device 100 is in a closed, storage position (closed position shown in FIG. 9).

The cross link 176 is shown pivotally attached at a first end 178 to the bottom end 112 of foot support structure 108 and has a second end 180 configured to latch to the bottom end 110 of the hand support structure 102. As shown in FIGS. 2 and 5, cross link 176 may include a movable latch 182 configured to engage a receptor 184 on the hand support structure 102. Alternatively, this arrangement of the cross link 176 may be oppositely configured, and may be positioned at any point from the top ends 104, 106 to the bottom ends 110, 112 of the hand support structure 102 and foot support structure 104. When the exercise device is in the open position forming an A-frame shape with the hand support structure 102 and the foot support structure 108, the cross link 176 may be pivoted into a secure latching position where latch 182 engages receptor 184. Alternatively, cross link 176 may include at least one hinge (not shown) between pivots at the first and second ends 178, 180 such that the cross link can be pivotally collapsed like a step ladder. In an alternative embodiment, (not shown), the hand support structure 102, the foot support structure 108, and/or the cross link 176 may include further jointed or telescoping features to reduce the height of the exercise device 100 in the closed position, to provide an even more compact design for ease of storage. Exercise device 100 may be formed of any suitable material such as metal, fiberglass, resin, composites, or a combination thereof.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. An exercise device for use in performing pushups, the exercise device comprising:

an elongated hand support structure adjacent an elongated foot support structure, wherein:

a top end of the hand support structure is attached to a corresponding top end of the foot support structure, and at least a bottom end of the hand support structure is spaced apart from a corresponding bottom end of the foot support structure;

the hand support structure comprises a pair of laterally spaced-apart, generally parallel elongate hand support rails having longitudinally spaced-apart handle mounts;

the foot support structure comprises a pair of laterally spaced-apart, generally parallel elongate foot support rails having longitudinally spaced-apart platform mounts; and the exercise device further comprises:

a handle configured for selectable attachment to the handle mounts; and a foot platform configured for selectable attachment to the platform mounts.

2. The exercise device of claim 1 wherein:

the handle mounts comprise pairs of laterally opposed apertures in the hand support rails configured for selectably receiving the handle.

3. The exercise device of claim 2 wherein:

at least one of the apertures and the handle comprise a quick-release feature.

4. The exercise device of claim 1 wherein:

the handle comprises a contoured portion having one or more angled bends configured to provide an ergonomic position for a user's hand when performing pushups.

5. The exercise device of claim 1 wherein:

the handle further comprises a cushioned hand grip portion.

6. The exercise device of claim 1, wherein:

the handle is configured as a left handle paired with a separate right handle for selectable attachment to a corresponding pair of the handle mounts.

7. The exercise device of claim 6 wherein:

the handle is configured for attachment to the hand support rails such that the left handle extends outwardly away from the handle mount on a left side hand support rail and the right handle extends outwardly away from the handle mount on a right side hand support rail.

8. The exercise device of claim 1 wherein:

the foot platform is configured such that, when attached to the platform mount, it comprises a generally horizontal base extending widthwise between the pair of foot support rails, and having a width and a depth dimension configured for suitable support of a user's feet while performing pushups.

9. The exercise device of claim 1 wherein:

the foot platform comprises at least one of a slip-resistant surface, a front raised edge, a back raised edge, a depression, and a stirrup.

10. The exercise device of claim 1 wherein:

the platform mount further comprises a cross brace laterally extending between, and attached to the pair of foot support rails.

11. The exercise device of claim 10 wherein the foot platform comprises:

a hook configured to hook behind the cross brace of the platform mount; and a strut extending downward to supportingly engage at least one of the foot support rails when the foot platform is selectably attached to the platform mount.

12. The exercise device of claim 1, further comprising:

at least one cross link configured for attachment between the hand support structure and the foot support structure.

13. The exercise device of claim 12 further comprising:

a collapsible A frame structure wherein:

a pivot is configured for pivotal attachment of the top end of the hand support structure to the corresponding top end of the foot support structure; and the cross link is configured for selectably latching at a full length to space apart the bottom ends of the hand support structure and the foot support structure, or collapsing to position the hand support structure substantially adjacent and parallel to the foot support structure.

14. The exercise device of claim 13, further comprising:

one or more wheels configured for rollingly moving the exercise device when it is positioned to engage the one or more wheels on a supporting surface.

15. The exercise device of claim 1 further comprising:

one or more slip-resistant floor pads on a bottom surface thereof.

16. The exercise device of claim 1, further comprising:

a separate floor platform configured for selectable attachment of the handle.

17. The exercise device of claim 16 wherein:

the floor platform comprises a base and a pair of spaced-apart handle mounts extending upwardly therefrom, wherein the handle is configured as a left handle paired with a separate right handle for selectable attachment to the corresponding pair of the handle mounts such that the distal end of the handles extend outwardly away from the floor platform and are elevated above any surface therebelow.

18. An exercise device for use in performing pushups, the exercise device comprising:

an elongated hand support structure adjacent an elongated foot support structure, wherein:

a top end of the hand support structure is pivotally attached to a corresponding top end of the foot support structure, and at least a bottom end of the hand support structure is spaced apart from a corresponding bottom end of the foot support structure to form a generally A-frame shape when the device is in an open position;

the hand support structure comprises a pair of laterally spaced-apart, generally parallel elongate hand support rails having longitudinally spaced-apart pairs of handle mounts;

the foot support structure comprises a pair of laterally spaced-apart, generally parallel elongate foot support rails having longitudinally spaced-apart platform mounts; and the exercise device further comprises:

a pair of handles configured for selectable attachment to the corresponding pair of the handle mounts;

a foot platform configured for selectable attachment to the platform mounts; and a cross link configured for attachment between the hand support structure and the spaced-apart foot support structure when the device is in an open position;

wherein the cross link is configured for pivotal movement from a collapsed storage position when the device is in a closed position into a secure latching position when the device is in the open position.

* * * * *